United States Patent [19]

Weeks

[11] 4,032,079

[45] June 28, 1977

[54] FISHTAPE HOLDER

[76] Inventor: Robert W. Weeks, 12233 Ashworth North, Seattle, Wash. 98133

[22] Filed: Aug. 20, 1975

[21] Appl. No.: 597,650

[52] U.S. Cl. ..... 242/85.1; 242/96

[51] Int. Cl.[2] ..... B65H 75/36; B65H 75/40

[58] Field of Search ..... 242/96, 104, 105, 129, 242/85.1; 24/115 R, 115 A, 115 H, 115 J, 115 K, 122.3, 122.6, 129 R, 129 B, 129 D, 131 R, 131 C, 132 CS, 132 CL; 254/134.3 FT, 134.5; 174/135, 136

[56] References Cited

UNITED STATES PATENTS

| | | | |
|---|---|---|---|
| 1,558,059 | 10/1925 | Stack | 242/54.4 |
| 2,743,884 | 5/1956 | Briggs | 242/85.1 |
| 3,005,620 | 10/1961 | Trunnell | 254/134.3 |
| 3,053,472 | 9/1962 | Stewart | 242/96 |
| 3,528,644 | 9/1970 | Scott | 254/134.3 FT |
| 3,568,947 | 3/1971 | Oprins | 242/85.1 |

FOREIGN PATENTS OR APPLICATIONS

| | | | |
|---|---|---|---|
| 663,182 | 8/1929 | France | 174/135 |

*Primary Examiner*—Leonard D. Christian

[57] ABSTRACT

A section of tubing having a sufficiently large diameter to accommodate several lengths of wire of the sort useful as a fishtape. The section of tubing is curved so as to form an arc of sufficient length such that the fishtape may be looped several times through the large-diameter tubing, providing a convenient storage therefor. The large-diameter tubing includes a short piece of small diameter tubing which is positioned on the inside wall of the large diameter tubing and which functions both as restraint for the projecting end of the fishtape and also as a guide for the fishtape as it is extended from the holder in operation.

6 Claims, 4 Drawing Figures

FISHTAPE HOLDER

BACKGROUND OF THE INVENTION

The object of the invention is to provide an inexpensive fishtape holder which is useful in the electrical construction trade and which has the characteristics of improved speed of operation, ease of operation, and ease of storage.

SUMMARY OF THE INVENTION

Accordingly, the present invention includes (1) a section of tubing which defines a segment of an annular ring, the tubing having a diameter which is sufficiently large to accommodate several coils of fishtape, and (2) a fishtape guide which is attached to the section of tubing, the guide having an opening therethrough which is capable of receiving the fishtape. In practice, one end of the fishtape is inserted through the guide means and then looped back through the tubing and secured to a selected point along the length of fishtape, thereby forming a single fishtape coil of selected diameter. Further in practice, the tubing is held stationary by the operator and the coil(s) of fishtape on the holder rotated continuously through the large diameter tubing as the fishtape is pulled away from or retrieved onto the holder through the guide.

DESCRIPTION OF THE DRAWINGS

A more thorough understanding of the invention may be obtained by a study of the following detailed description taken in connection with the accompanying drawings in which.

DESCRIPTION OF PREFERRED EMBODIMENT

Figure 1:
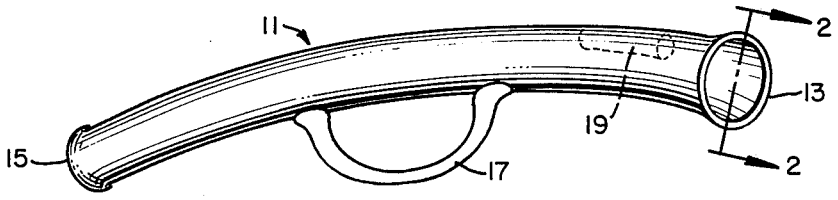
FIG. 1 is a pictorial view showing the general configuration of the fishtape holder of the present invention.
Figure 2:
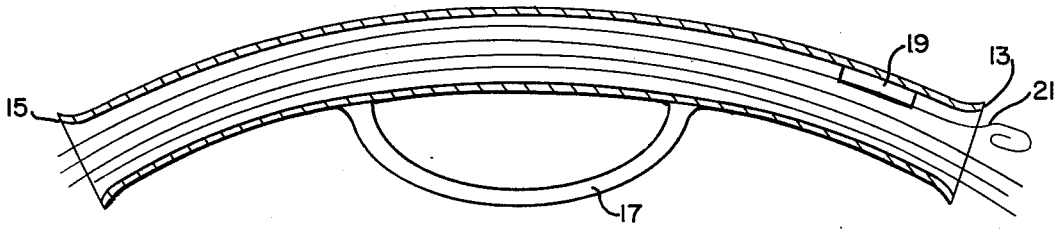
FIG. 2 is a cross-section view taken along the lines 2—2 of FIG. 1, with the fishtape shown coiled thereon.
Figure 3:
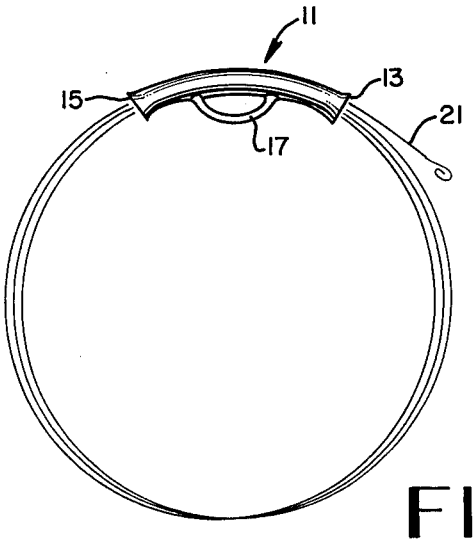
FIG. 3 is a side view of the fishtape holder of FIGS. 1 and 2 showing the fishtape in a coiled position thereon.
Figure 4:
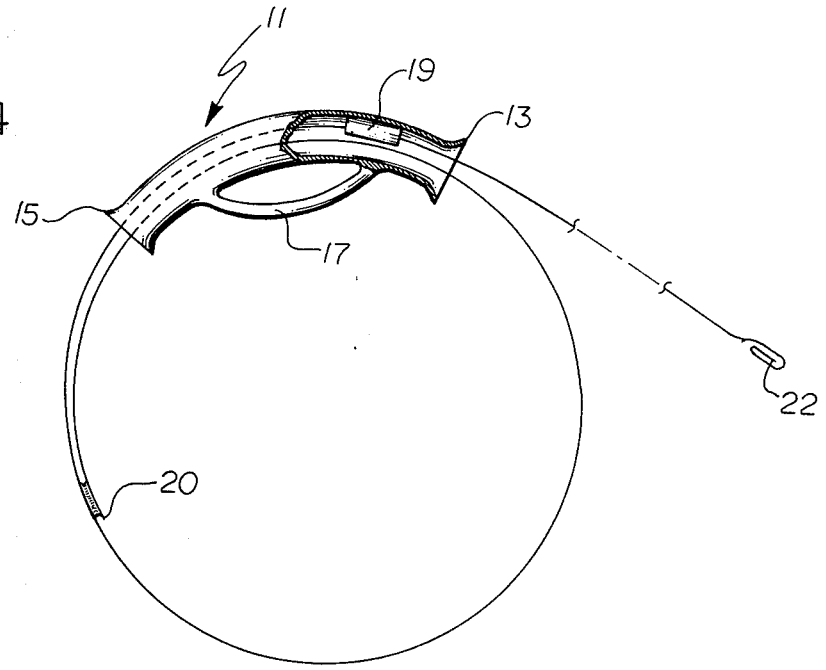
FIG. 4 is a side view of the fishtape holder showing the formation of the first fishtape coil.

Referring to FIGS. 1, 2 and 3, the fishtape holder includes a section of large-diameter tubing for holding the fishtape, the tubing being approximately 12 inches long, shown generally at 11, and being slightly bent to form part of a circle. The respective ends 13 and 15 of holder tubing 11 are slightly flared. A thumbhole support comprising a generally U-shaped element 17 is fastened to the underside of holder tubing 11 approximately intermediate of ends 13 and 15, so that it projects downwardly therefrom. The thumbhole support 17 functions as a grip for the fishtape holder when it is in operation and as a hanger therefor when it is being stored.

A small section of small-diameter tubing shown generally at 19 is fastened inside one end of holder tubing 11 and acts as a guide for the fishtape 21. In the preferred embodiment, guide tubing 19 is approximately 1 inch long.

One end 20 of the fishtape 21 is inserted through the guide tubing 19 and then through the holder tubing 11 forming a circle of desired size. It is then taped or welded to this shape. The rest of the fishtape 21 is rolled inside the holder tubing 11 with the other end 22 of fishtape 21 remaining free.

The size of the holder tubing and guide tubing may vary according to the size of the fishtape. An example would be a ⅛ inch fishtape with a ¾ inch holder tubing and a ¼ inch guide tubing.

The fishtape holder is to be used by the electrical construction trade. The major purpose is to provide a fishtape holder that can be unrolled and rolled with ease, speed, and lack of entanglement. Also, one that can be produced for a much lower cost than those presently on the market.

What is claimed is:

1. A fishtape holder, comprising:

a section of tubing defining a segment of an annular ring, said tubing having a sufficiently large diameter to permit a length of fishtape to be looped therethrough at least several times; and guide means attached to said section of tubing, said guide means having an opening therethrough for receiving the fishtape, said guide means functioning as a guide for the removal or retrieval of the fishtape relative to said fishtape holder, one end of the fishtape being initially inserted through said guide means, looped through said tubing, and then secured to a point along the length of the fishtape to form a single fishtape coil of selected diameter, said fishtape holder being held stationary in operation so that the single fishtape coil rotates continuously through said section of tubing as the remainder of the fishtape is pulled away from or retrieved onto said fishtape holder.

2. An article of claim 1, wherein the length of said tubing is less than one-half the length of a complete annular ring.

3. An article of claim 1, wherein the respective opposite ends of said tubing are flared so as to facilitate entry and exit of the fishtape therefrom.

4. An article of claim 1, including a grip element which permits said tubing to be held securely when said holder is in operation, and permits said tubing to be conveniently hung when said holder is not in operation.

5. An article of claim 4, wherein said grip element is U-shaped and secured to the underside of said tubing substantially intermediate its respective opposite ends.

6. An article of claim 2, wherein said tubing forms approximately one-sixth of an annular ring.

* * * * *